United States Patent [19]

Mercer, Sr.

[11] 4,150,550

[45] Apr. 24, 1979

[54] SELF DEFROSTING REFRIGERATED DISPLAY CASE

[75] Inventor: John F. Mercer, Sr., Globe, Ariz.

[73] Assignee: George W. Leech, Globe, Ariz.

[21] Appl. No.: 848,112

[22] Filed: Nov. 3, 1977

[51] Int. Cl.[2] ..... A47F 3/04

[52] U.S. Cl. ..... 62/252

[58] Field of Search ..... 62/252, 253, 256, 248, 62/441, 442

[56] References Cited

U.S. PATENT DOCUMENTS

| | | | |
|---|---|---|---|
| 1,551,120 | 8/1925 | Sala | 62/252 |
| 2,495,327 | 1/1950 | Hardin | 62/253 |
| 2,586,225 | 2/1952 | Hartman | 62/252 |
| 2,657,545 | 11/1953 | Knight | 62/252 |
| 3,044,274 | 7/1962 | Mathis et al. | 62/252 |
| 3,584,467 | 6/1971 | Barroero | 62/252 |

*Primary Examiner*—Lloyd L. King

*Attorney, Agent, or Firm*—Cahill, Sutton & Thomas

[57] ABSTRACT

A refrigerated display case for food stuffs diffuses a supply of dry chilled air around and about a plurality of cold shelves to preclude the formation of frost and to defrost the display case subsequent to introduction of warmer moist air. The flow of dry chilled air is exhausted through a port located above the top shelf, whereby natural convection within the display case insures continual exhaustion of the highest temperature air.

7 Claims, 2 Drawing Figures

SELF DEFROSTING REFRIGERATED DISPLAY CASE

The present invention relates to refrigerated food display cases and, more particularly, to frost free and self defrosting display cases.

Prior art refrigerated display cases which utilize evaporator coils integral with the display case and in intimate heat conducting relationship with the product display zone have certain inherent drawbacks which become particularly acute when the humidity exceeds a low threshold value. The product display zone can frost up very quickly to the extent that defrosting activity must take place as often as several times per day. A heating element to melt the frost must be energized and the heating element must have substantial capacity to achieve defrosting within a reasonable time. Under severe frosting and icing conditions, the products must be removed from the display zone before the defrosting cycle is initiated. When the defrost cycle is completed, the refrigeration unit is activated and the problem of refreezing melted ice which has not drained properly becomes a problem.

Icing of the evaporator coils can and does cause repeated damage to the refrigeration system such that the cost of maintenance, coupled with the obvious uneconomic situations created by the necessity for frequent defrosting, gives rise to serious objections to existing refrigerator display cases.

Various refrigeration systems of the types discussed above are illustrated in the following U.S. Pat. Nos. 2,598,156, 3,186,185, 3,063,255, 3,366,432, 3,577,744, 3,696,630 and 3,933,006.

My U.S. Pat. No. 3,250,085, issued May 10, 1966, describing my refrigerated display case system overcame some of the objections attendant prior art display cases. However, this system suffered from certain inefficiencies and drawbacks attendant the introduction of makeup air and thermal transfer attendant the product display zone and the refrigeration system. These problems were overcome to an extent, in my improved refrigerated display case system disclosed in U.S. Pat. No. 3,577,744, issued May 4, 1971. This system, however, still suffered from certain drawbacks attendant the enveloping of the refrigerated items with sufficient flow of low temperature low humidity air. In addition, the area of display space was somewhat limited and overcrowding of the products negatively affected the chilling effect of the cooling air.

My present invention is directed to a two compartmented display case for refrigerated products wherein a first compartment receives and mixes an inflow of dry cold air. This mixed dry cold air is diffused through a screen into a second compartment having shelves for the refrigerated products. A port, located above the highest shelf, vents through convection and natural circulation processes, the higher temperature cold air. Thereby, the refrigerated products are continually immersed within a fresh flow of dry cold air to maintain the refrigerated products chilled and to preclude frosting by absorbing any moisture present and exhausting the absorbed moisture through the port.

It is therefore a primary object of the present invention to provide a refrigerated display case which automatically defrosts the product display zone.

Another object of the present invention is to provide a continuous flow of dry cold air around and about the products within the display zone.

Still another object of the present invention is to provide a diffused source of dry cold air for the product display zone.

Yet another object of the present invention is to provide cold shelves for the products displayed while enveloping the products within a flow of dry cold air.

A further object of the present invention is to provide a display case for refrigerated products having an inlet for dry cold air, a first compartment, a diffuser, a second compartment and an exhaust port located in proximity to the top of the second compartment.

A further object of the present invention is to provide an outlet port for a display case which exhausts the highest temperature air within the display case.

A still further object of the present invention is to provide a display zone for refrigerated products accessible through a door.

These and other objects of the present invention will become apparent to those skilled in the art as the description thereof proceeds.

The present invention may be described with greater specificity and clarity with reference to the following drawings, in which.

Figure 1:
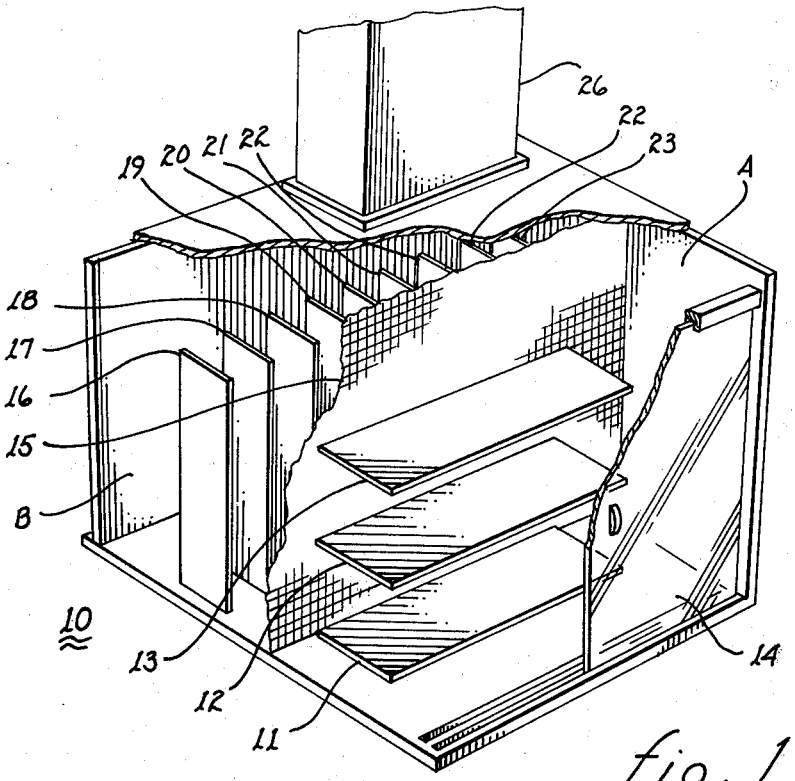
FIG. 1 is a partially cutaway perspective view of the arrangement and structure of the elements within a refrigerated display case.

Referring to the figures, there is shown a display case 10 having a plurality of stacked shelves 11, 12 and 13 for displaying refrigerated products in a front compartment A of the display case. Access to the refrigerated products is provided at the front of display case 10 through sliding doors, of which door 14 is illustrated. Alternatively, the door or doors may be hinged at the center front or at the lateral edge or edges of the display case. A rear compartment B of the display case, separated from the front compartment by a finely woven screen 15, includes a plurality of vertically extending cold plates 16, 17, 18, 19, 20, 21, 22 and 23. An inlet 25 is disposed in the top of compartment B, which inlet is in communication with a duct 26. Duct 26 is connected to a source of dry cold air, which source may be equivalent to any one of several commercially available units for producing a flow of dry cold air.

Cold plates 16, 17, 18, 19, 20, 21, 22 and 23 are of thermally conductive material and further chill the air flowing into and about compartment B. In one embodiment, the tops and bottoms of cold plates 16, 17, 18, 19, 20, 21, 22 and 23 may be attached to a pair of opposed channels 30 and 31, which have embedded therein cooling coils or are otherwise chilled to draw heat from the cold plates. Alternatively, cooling coils may be disposed within each of cold plates 16, 17, 18, 19, 20, 21, 22 and 23 to chill the cold plates and further cool the air flowing into compartment B. It may be noted that compartment B serves in the nature of a plenum to provide a source of generally uniformly distributed dry cold air under pressure. The orientation and length of the cold plates promote a uniform distribution of the dry cold air within compartment B.

The dry cold air under pressure within compartment B will tend to flow into the lower pressure environment within compartment A through screen 15. The screen is of finely woven material and serves as a diffuser for diffusing the flow of dry cold air. Since compartment B is under an essentially homogeneous pressure due to the pressure equalizing effect of the screen, an essentially uniform flow of air will pass through the screen from top to bottom and side to side.

The dry cold air flowing into compartment A will flow in and about cold shelves 11, 12 and 13 to draw heat from the products placed upon the shelf. Through normal convection processes within compartment A, the air warmed by the products will tend to rise while the cooler air will tend to settle in the bottom. However, the air within compartment A will not be stagnant since there is a continuing flow of cooled air through screen 15.

The air within compartment A rising to the top, will be exhausted from the compartment through port 35 extending across the full width of the front of the display case intermediate the top of door 14 and top 37 of the display case. Accordingly, the air warmed within compartment A by the products will be exhausted through port 35 and replaced by cooler air flowing in through screen 15 and the products will be continually enveloped within dry cold air.

Shelves 11, 12 and 13 may also be cold plates chilled by means of one of cooling coils 40, 41 and 42 associated with each shelf. Thereby, these shelves directly draw heat from the products placed thereupon. These shelves, being placed transverse to the convective air flow within compartment A promote uniform distribution of the air flow within the compartment.

Figure 2:
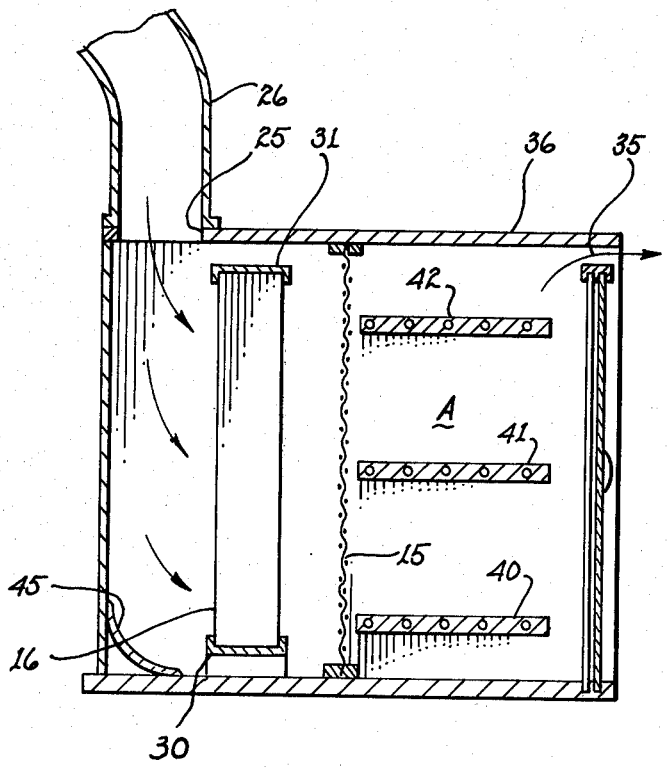
FIG. 2 is a cross-sectional view of a refrigerated display case illustrating the flow of air therethrough.

Baffles, such as baffle 45 in compartment B shown in FIG. 2, may be employed to direct a smooth flow of air through compartments A and B. Thereby cold spots are avoided, stagnant captured air pockets are eliminated and a uniform continuing flow in and about shelves 40, 41 and 42 and the products displayed thereupon is promoted.

Since the air flowing within compartments B and A is dry cold air, it will tend to absorb whatever moisture it can from within the display case. Such absorbtion, resulting in a temperature rise of the air and subsequent exhaustion of the higher temperature air through port 35, maintains compartment A moisture free. Without moisture, no frost will develop within compartment A upon its surfaces or upon the products themselves. Accordingly, compartment A will be maintained frost free.

On opening of door 14 or the doors at the front of the display case, the chilled air within compartment A will be replaced in part or in whole by an inrushing quantity of ambient air. When the ambient air strikes the chilled surfaces and products within compartment A, some frosting may occur as a natural phenomenon. However, on reclosing of door 14, the inflowing dry cold air through screen 15 will tend to flow to the bottom of compartment A and force the warmer air upwardly. The resulting upward air flow will ultimately be exhausted through port 35.

Within a very short period, the moister warmer air will have been completely purged by the dry cold air from compartment B. The dry cold air, being well below dew point, will tend to absorb whatever moisture exists within compartment A. Thus, should frost exist within compartment A, the moisture represented by the frost will be evaporated and absorbed by the dry cold air and ultimately exhausted through port 35. Thereby, self defrosting occurs upon closure of door 14.

It may be noted that port 35 is located above top shelf 13. Such a location insures that the air in and about the products displayed upon shelf 13 is at or below the temperature of the air being exhausted.

From the above, it will become evident that the display case need never be heated to evaporate and/or melt any frost developing therein. Thereby, it is unnecessary to unload and reload the display shelves with the attendant danger of spoilage of the products. Because of the self defrosting capability of the system, repetitive access to the display shelves through door 14 may be permitted, such as in a supermarket, without fear of continuing excessive frost formation. Even if an excessive amount of frost were formed, the air flow occurring during nighttime, after closing of the store, would be sufficient to completely defrost the display case by morning. Thus, not only are the products better protected than in prior art display cases, but the expenses of the labor associated with defrosting are completely obviated.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A refrigerated display case for maintaining a frost free product environment, said display case comprising in combination:

a. a source of dry cold air;

b. a first compartment for receiving and mixing the dry cold air under pressure;

c. a second compartment for storing refrigerated products, said second compartment including door means for providing access to the products;

d. a screen disposed intermediate said first compartment and said second compartment for diffusingly conveying the dry cold air from said first compartment to said second compartment in response to the pressure differential attendant said first and second compartments;

e. a port disposed in the upper part of said second compartment for exhausting the higher temperature air within said second compartment and maintaining said second compartment at a pressure lower than said first compartment;

whereby, said second compartment and the products are immersed in a continuous flow of dry cold air to absorb any moisture and the moisture entrained air is exhausted through said port to preclude the formation and continuing existence of frost.

2. The display case as set forth in claim 1 including a plurality of cold plates disposed within said first compartment for chilling the inflowing dry cold air.

3. The display case as set forth in claim 1 including a plurality of shelves disposed within said second compartment for supporting the products.

4. The display case as set forth in claim 3 wherein said plurality of shelves comprise cold plates for chilling the products and the dry cold air within said second compartment.

5. The display case as set forth in claim 1 wherein said screen comprises a finely woven screen.

6. The display case as set forth in claim 5 wherein said port is disposed intermediate the top edge of said door means and the top of said second compartment.

7. The display case as set forth in claim 6 including baffle means for directing the air flow within said display case.

* * * * *